US005431119A

United States Patent [19]

Sato et al.

[11] Patent Number: 5,431,119

[45] Date of Patent: Jul. 11, 1995

[54] THREAD END HOLDING DEVICE FOR A SEWING MACHINE

[75] Inventors: Shuichi Sato; Yoshiharu Kobayashi, both of Utsunomiya; Norio Komori, Tochigi; Shirou Ayusawa, Utsunomiya, all of Japan

[73] Assignee: The Singer Company N.V., Curacao, Netherlands

[21] Appl. No.: 133,233

[22] Filed: Oct. 7, 1993

[51] Int. Cl.[6] ..... D05B 53/00

[52] U.S. Cl. ..... 112/253

[58] Field of Search ..... 112/253, 286, 285

[56] References Cited

U.S. PATENT DOCUMENTS

| | | | |
|---|---|---|---|
| 4,913,073 | 4/1990 | Komori | 112/253 X |
| 5,025,738 | 6/1991 | Sato et al. | 112/253 X |
| 5,044,290 | 9/1991 | Sato et al. | 112/286 |

*Primary Examiner*—Clifford D. Crowder
*Assistant Examiner*—Paul C. Lewis
*Attorney, Agent, or Firm*—McCormick, Paulding & Huber

[57] ABSTRACT

A thread end holding device for a sewing machine comprises a needle thread catching puller which is swingably supported on the side of a sewing machine arm and is driven to swing between a thread catching position and a home position, and which comprises a hook portion at the tip end thereof for catching a needle thread extending from a needle when said needle thread catching puller is at its thread catching position and holds the needle thread at its home position and first and a second holding members which are respectively mounted on the side of the sewing machine arm and is disengaged from the both clamping portions when the needle thread catching puller is at its thread catching position and enters a gap between the both clamping portions at the hook portion thereof so as to elastically clamp the end of the needle thread between the clamping portions when the needle thread catching puller is at its home position. As a result, the needle thread catching puller and the first and second holding members can have simple shapes and high rigidity, and moreover can be accommodated in the side of the sewing machine arm so that the sewing machine may be compact in size. Moreover, they do not obstruct handling a cloth etc. on a needle throat.

2 Claims, 4 Drawing Sheets

THREAD END HOLDING DEVICE FOR A SEWING MACHINE

BACKGROUND OF THE INVENTION

1. Field of the Invention

The present invention relates to a thread end holding device for a sewing machine.

2. Description and Problems of the Related Art

A thread end holding device, which is a device provided in a sewing machine equipped with a thread trimming device, pulls out an end of a needle thread above a cloth having been sewn and clamps the same after needle and bobbin threads are cut under the cloth after sewing the cloth is completed, and has a function to prevent the end of the needle thread from being entangled like a bird's nest on the rear side of the cloth when the sewing is resumed for the cloth.

A conventional thread end holding device for a sewing machine, for example, is disclosed in the Japanese Patent Laid-Open Publication No. 2-078177. That is the thread end holding device which is provided on the side of a sewing machine arm 1 and is driven by an electromagnetic solenoid 3 to swing between a lower thread catching position and an upper home position, and which comprises a needle thread catching puller 111 having a hook portion 111A at the tip end thereof for catching a needle thread NT extending from a needle 12 when the thread end holding device is at the thread catching position, and a first and second holding members 114 and 115 respectively fixed to the side of the sewing machine arm 1 for elastically clamping the thread end NTE of the needle thread NT caught by the hook portion 11A therebetween when the needle thread catching puller 111 is at the home position as illustrated in FIGS. 4 and 5. Denoted at 2 is a supporting plate, 3A is the plunger of the electromagnetic solenoid 3, 4 is a supporting shaft, 5 is a connecting link, 6 is a swinging link, 7 is a coiled spring, 8 is a driving link, 9 is a needle thread catching puller supporting shaft, 10 is a driving crank, 13 is a cloth and 16 is a sewing machine bed.

Such a conventional thread end holding device, however, has the following technical problems.

(1) Since the needle thread catching puller 111 has a bent portion 111B to be L-shaped as a whole in a front view as illustrated in FIG. 4, it is impossible to accommodate the needle thread catching puller 111 in the side of the sewing machine arm I when the needle thread catching puller 111 is at its home position so that the sewing machine may be compact in size. Moreover, since the hook portion 111A is located close to the upper surface of a needle throat at its home position, it prevents handling the cloth on the needle throat etc., so that the efficiency of sewing operation is lowered.

(2) Since the needle thread catching puller 111 has the bent portion 111B to be L-shaped in the front view, it is comparatively low in rigidity and inferior in durability. Moreover, since the needle thread catching puller 111 is designed to always engage the clamping portions 114B and 115B of the first and second holding members 114 and 115 at the hook portion 111A thereof, the needle thread catching puller 111 has to have a circular arc shape which has the center thereof at a needle thread catching puller supporting shaft 9 with high accuracy, so that manufacturing the same is not easy.

Furthermore, the first and second holding members 114 and 115 have to be complicated in shape so that they may not interrupt the swinging of the needle thread catching puller 111 about the needle thread catching puller supporting shaft 9. As a result, the clamping portions 114B and 115B can hardly secure the elastic clamping force therebetween stably, are not easy in manufacturing and are inferior both in durability and operational reliability. Still furthermore, it is difficult to give a same shape to the first and second holding members 114 and 115, which makes the manufacturing more troublesome.

(3) A sharp tip end projection 111C is formed so as to form a thread guide portion 111D for pushing off the thread end NTE at the lower portion of the hook portion 111A of the needle thread catching puller 111 as illustrated in FIG. 5, and the sharp tip end projection 111C and the clamping portions 114B and 115B of the first and second holding members 114 and 115 are provided comparatively close to the upper surface of the needle throat of the sewing machine bed 16, so that the cloth or the needle thread is liable to be caught by the tip portions of the needle thread catching puller 111 and the first and second holding members 114 and 115, which prevents the sewing operation when an operator handles the cloth or performs other various operations accompanying the sewing operation, resulting in a technical problem that the production efficiency and safety in sewing operation are lowered.

SUMMARY OF THE INVENTION

The present invention has been made from a viewpoint of such technical problems to provide a thread end holding device for a sewing machine comprising a needle thread catching puller 11 which is swingably supported by a supporting shaft 9 on the side of the sewing machine arm 1 and is driven by a driving device 3 to swing between a thread catching position and a home position, and which comprises a hook portion 11A at the tip end thereof for catching a needle thread NT extending from a needle 12 when the needle thread catching puller 11 is at its thread catching position and holding the needle thread NT at its home position, and a first and second holding member 14 and 15 which are respectively mounted on the side of the sewing machine arm 1 for elastically clamping the thread end NTE of the needle thread NT caught by the hook portion 11A between the clamping portions 14B and 15B thereof when the thread catching puller 11 is at its home position, characterized in that the needle thread catching puller 11 is disengaged from the clamping portions 14B and 15B when it is at its thread catching position while it enters a gap M between the clamping portions 14B and 15B with the hook portion 11A is directed upward when it is at its home position.

It is possible to provide the supporting shaft 9 close to the lower end of the jaw 1A of the sewing machine arm 1 and to position each of the clamping portions 14B and 15B of the first and second holding members 14 and 15 on a horizontal line passing the center of the supporting shaft 9.

When sewing the cloth is completed and the needle and bobbin threads are cut under the cloth by the operation of the thread trimming device, the needle is positioned adjacent to the upper dead point thereof, the needle thread extends substantially vertically from the needle into the cloth, and the needle thread catching puller is at its home position.

At this state, when the needle thread catching puller is turned by the driving device, the hook portion of the needle thread catching puller passes under the needle which is located adjacent to the upper dead point thereof and pushes away the substantially vertical needle thread to reach the extremity of swinging at its thread catching position. At that time, the needle thread catching puller is disengaged from the clamping portions.

Subsequently, when the needle thread catching puller is operated backward, it returns to its home position while catching the end of the needle thread at the hook portion thereof. At that time, the hook portion enters the gap between the clamping portions of the first and second holding members together with the end of the needle thread caught thereby. In this way, each clamping portion is elastically pressed against the both surfaces of the hook portion so that the needle thread caught by the hook portion is bent and the thread end thereof is clamped by the clamping portions at the both sides thereof. As a result, a large friction is applied to the thread end at the hook portion adding to the friction applied thereto between the clamping portions so as to hold the thread end firmly.

When the supporting shaft is provided close to the lower end of the jaw of the sewing machine arm and each clamping portion of the first and second holding members is located on a horizontal line passing the center of the supporting shaft, the needle thread catching puller is accommodated in the portion of the sewing machine arm adjacent to the jaw thereof when the needle thread catching puller is at its home position so that the sewing machine is compact in size.

PREFERRED EMBODIMENT OF THE INVENTION

An embodiment of the present invention will be described hereinafter.

Figure 1:
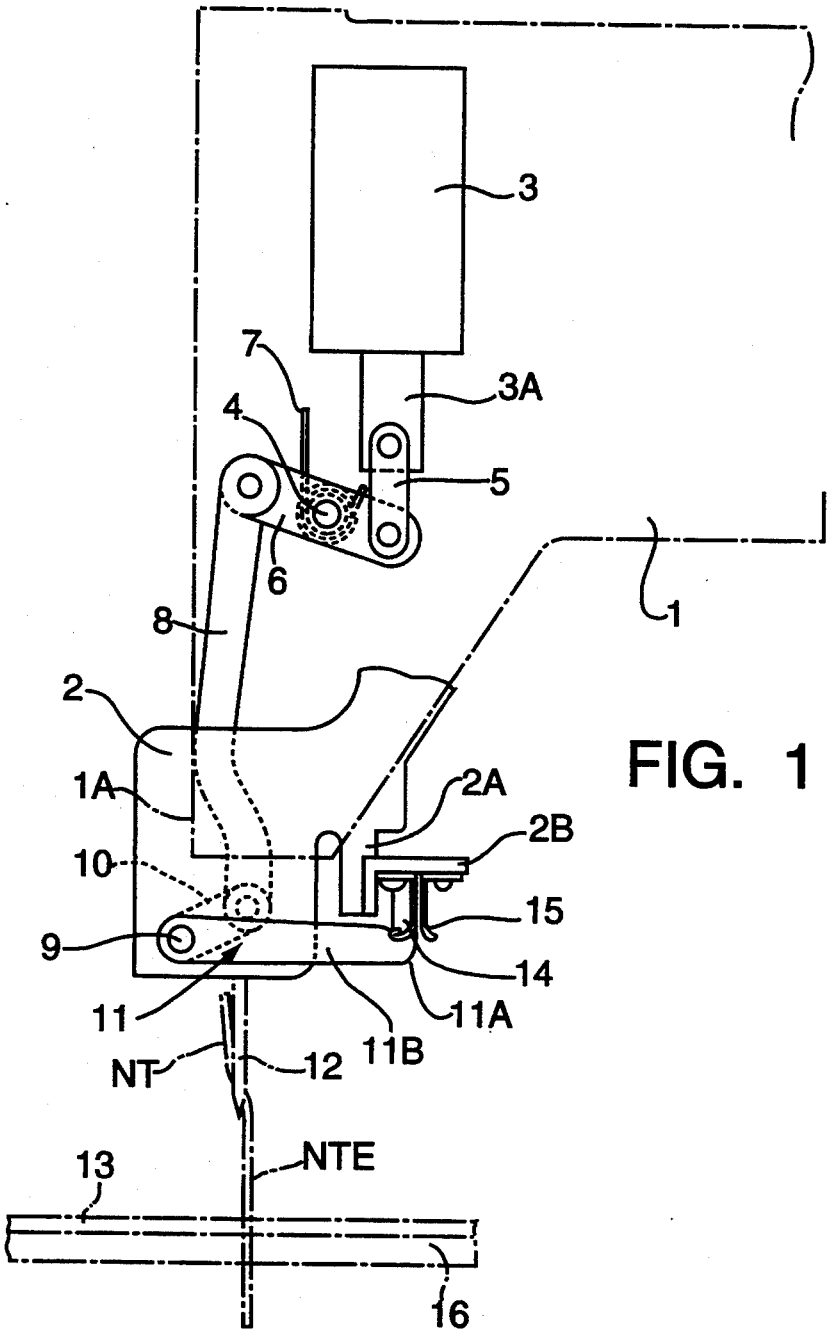
FIG. 1 is a front view showing a thread end holding device for a sewing machine according to an embodiment of the present invention.
Figure 2:
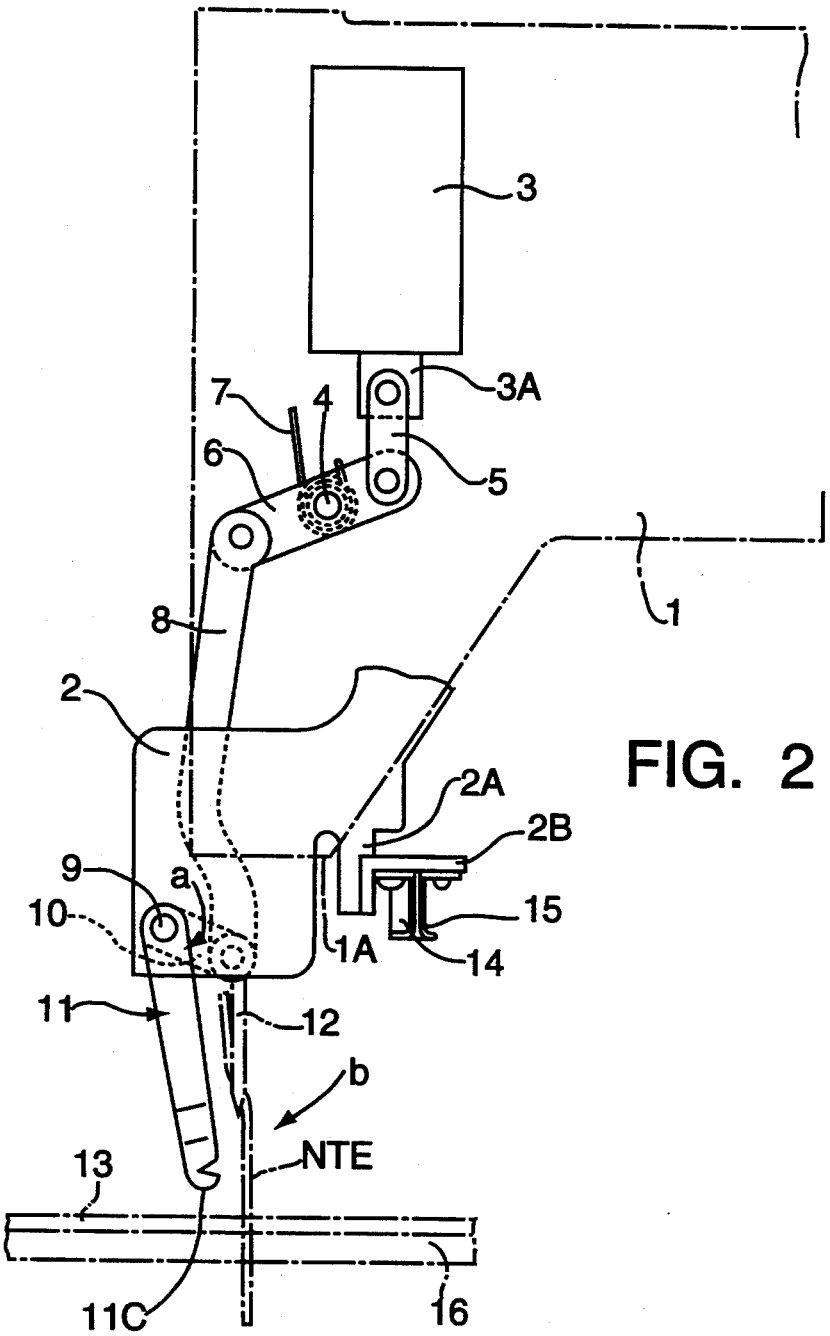
FIG. 2 is a view for explaining the function of the thread end holding device in FIG. 1.
Figure 3:
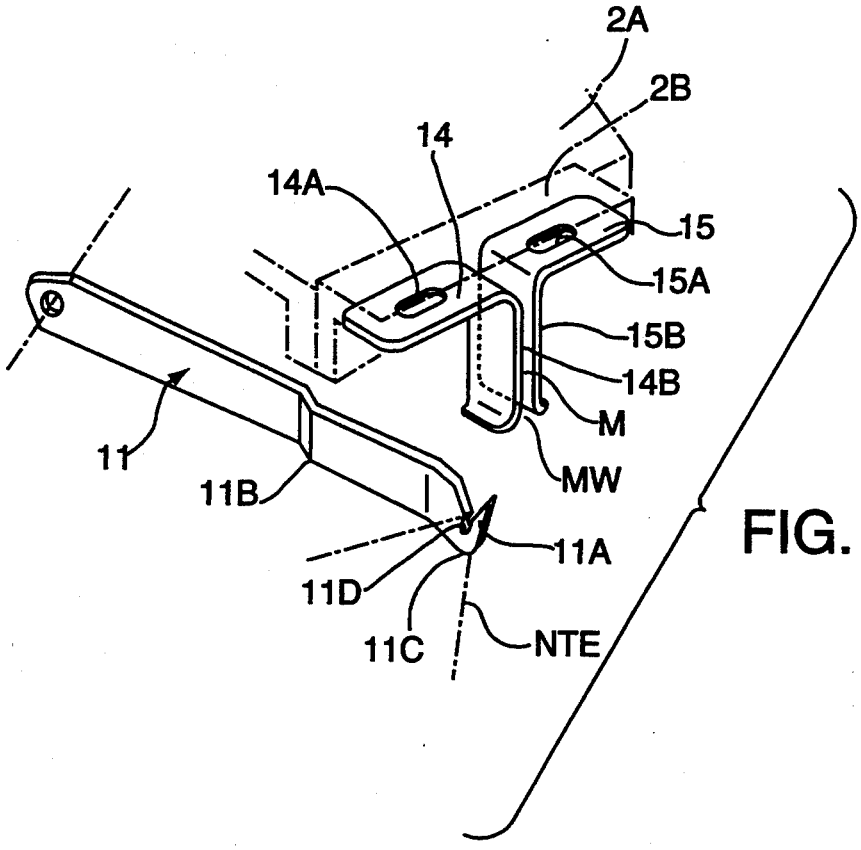
FIG. 3 is a perspective view showing a needle thread catching puller and first and second holding members in FIG. 1.
Figure 5:
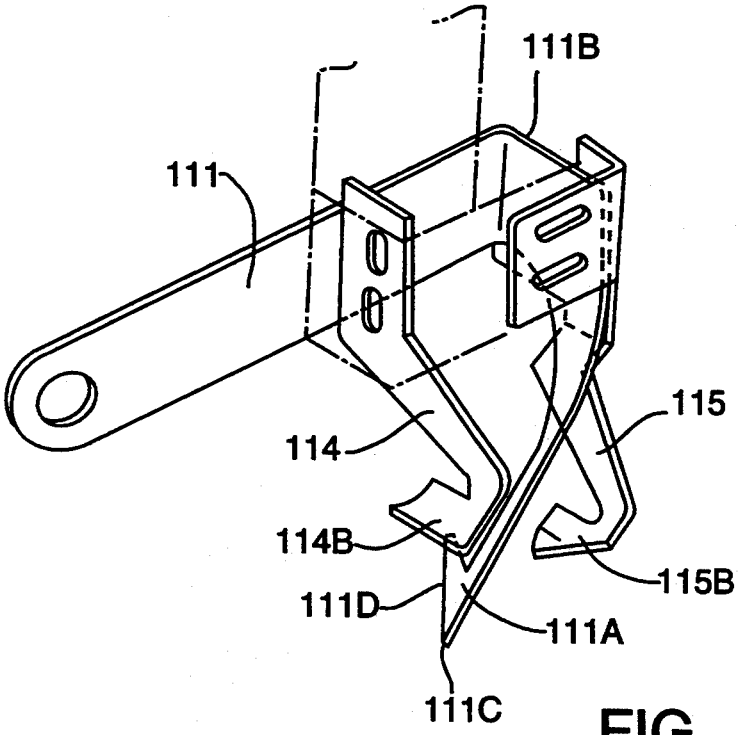
FIG. 5 is a perspective view showing a needle thread catching puller and first and second holding members in FIG. 4.
Figure 4:
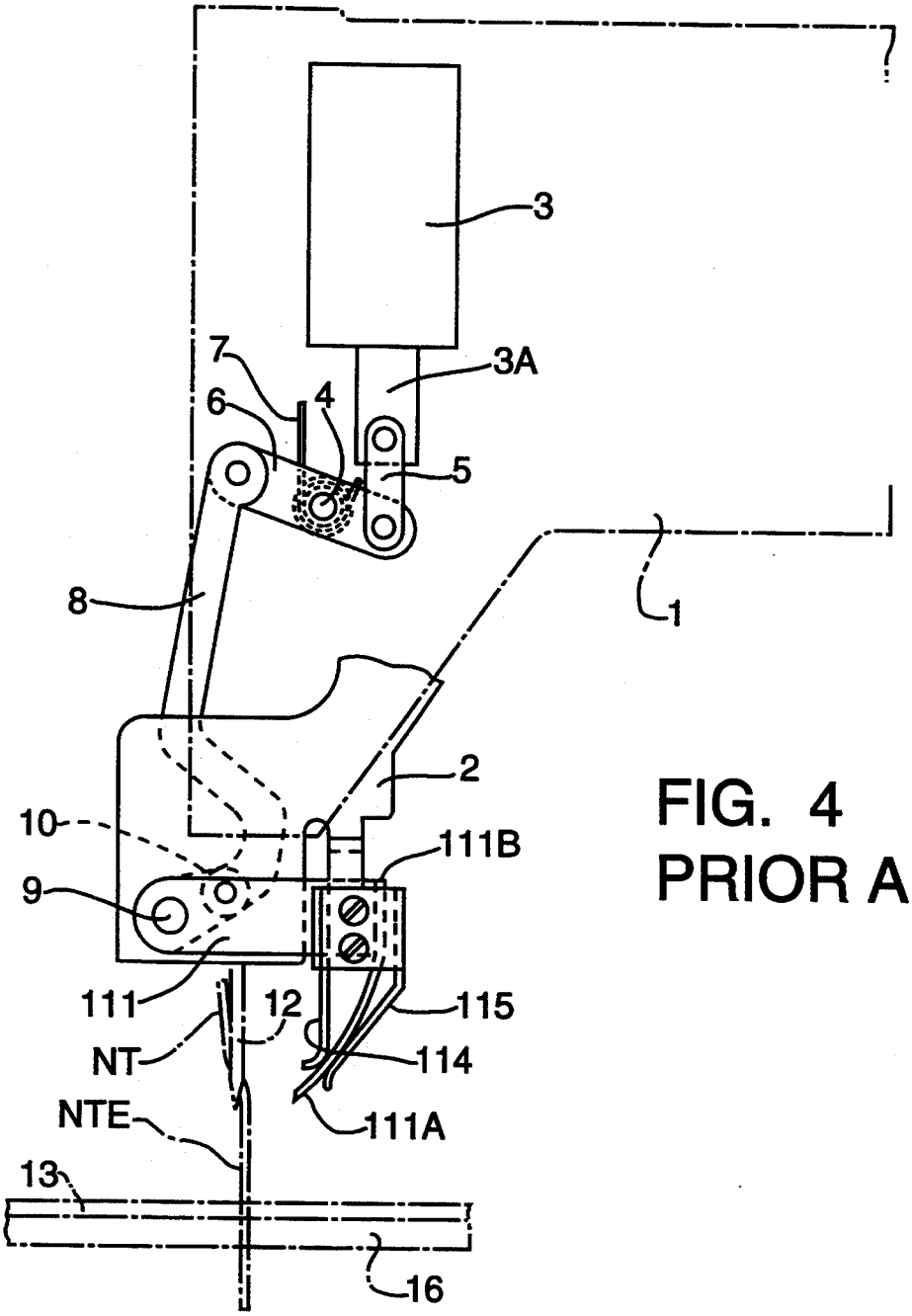
FIG. 4 PRIOR ART
FIG. 4 is a front view showing a conventional thread end holding device.

FIGS. 1 to 3 show an embodiment of the present invention, wherein the components which are substantially the same as those in prior art are denoted as the same numerals. In FIG. 1, denoted at 1 is a sewing machine arm, and an electromagnetic solenoid 3 which is a driving means for projecting therefrom and contracting thereinto a plunger 3A by way of an electric signal from a control device, not shown, is mounted on a supporting plate 2 fixed to the rear surface of the jaw 1A of the sewing machine arm 1. The tip end portion of the plunger 3A of the electromagnetic solenoid 3 is relatively swingably pinned to one end portion of a swinging link 6 by way of a connecting link 5, the swinging link 6 being swingably supported by the supporting plate 2 at the central portion thereof by way of a supporting shaft 4. The swinging link 6 is always forced to turn in such a way to pull out the plunger 3A to its home position by way of a coiled spring 7 which is wound about the supporting shaft 4 at the central portion thereof, is retained by one end portion of the swinging link 6 at one end portion thereof and is retained by the supporting plate 2 at the other end portion thereof.

Whereas the other end portion of the swinging link 6 is pinned to one end portion of a driving link 8, while the other end portion of the driving link 8 is pinned to the tip end portion of a driving crank 10. The base portion of the driving crank 10 is fixed to a needle thread catching puller supporting shaft 9 which is a supporting shaft rotatably projecting from the supporting plate 2 and to which the needle thread catching puller 11 is fixed. The needle thread catching puller supporting shaft 9 is arranged close to the lower end of the jaw 1A of the sewing machine arm I and more concretely, a little lower than the lower end of the jaw 1A.

The needle thread catching puller 11 is fixed to the needle thread catching puller supporting shaft 9 at the base portion thereof and comprises a hook portion 11A at the tip end portion of the arm portion 11B thereof, the hook portion 11A being a thread catching portion for catching the thread end NTE of the needle thread NT. The hook portion 11A formed adjacent to the tip end of the arm portion 11B has a shape of a letter V having the bottom portion 11D thereof. Denoted at 12 is a needle vertically reciprocating in the sewing machine arm 1, and a stitch is formed in a cloth 13 on a sewing machine bed 16, more concretely on the needle throat by a needle thread NT passing through the eye of the needle 12 and a bobbin thread, not shown.

The needle thread catching puller 11 seems to be linear substantially having no bent portion in a front view as illustrated in FIG. 1 and the hook portion 11A thereof with the opening thereof directed upward is positioned under and closely to the bracket portion 2B, described later, of the supporting plate 2 at its home position in a normal state. The hook portion 11A is located in a substantially horizontal direction relative to the center of the needle thread catching puller supporting shaft 9 at its home position in a normal state. The needle thread catching puller 11 has a plurality of bent portions in the arm portion 11B thereof in a plan view as understood from FIG. 3 so as to compensate the longitudinal discrepancy between the mounting position thereof on the needle thread catching puller supporting shaft 9 and the position of the needle thread end NTE of the needle thread NT.

The needle thread catching puller 11 has a function to be disengaged from the both clamping portions 14B and 15B, described later, when it moves to its thread catching position wherein the plunger 3A is contracted into the electromagnet solenoid 3 from its home position and to hook/catch the thread end NTE of the needle thread NT extending along the path of the vertically reciprocal motion of the needle 12 at the hook portion 11A thereof after it crosses the path. In order to protect the function, a chamfering portion 11C is formed at the tip end portion of the needle thread catching puller 11 on the corner opposite to the hook portion 11A thereof as illustrated in FIG. 3 so that the hook portion 11A may not hook but push off the thread end NTE of the needle thread NT when the hook portion 11A crosses the path of the vertically reciprocal motion of the needle 12.

Moreover, the supporting plate 2 comprises a bracket portion 2B having an L-shaped cross section formed at the lower end portion thereof by way of an arm portion 2A, and the base portions of the first and second holding members 14 and 15 for clamping the needle thread end NTE are fixed to the lower surface of a side portion of the bracket portion 2B by way of screws, not shown.

The first and second holding members 14 and 15 are both formed of spring members, of which the first holding member 14 has a base portion having a long hole 14A and a substantially vertical clamping portion 14B and the second holding member 15 has a base portion having a long hole 15A and a substantially vertical clamping portion 15B, the long holes 14A and 15A extending left fight in the base portions and the clamping portions 14B and 15B being connected to the base portions to form shapes of letters L and confronting each other to form a gap M therebetween as illustrated in FIG. 3. When the hook portion 11A of the needle thread catching puller 11 which has hooked and caught the needle thread end NTE of the needle thread NT returns to its home position, it enters the gap M and the clamping portions 14B and 15B on both sides thereof elastically clamp the needle thread end NTE cooperating with the hook portion 11A. The longitudinally extending direction of the gap M is conformed to the swinging direction of the hook portion 11A so that the needle thread catching puller 11 may be able to smoothly enter the gap M as it swings about the needle thread catching puller supporting shaft 9.

The arm portion 2A and the bracket portion 2B of the supporting plate 2 are formed in such a way as to position each of the clamping portions 14B and 15B of the first and second holding members 14 and 15 on a horizontal line passing the center of the needle thread catching puller supporting shaft 9. The mounting positions of the first and second holding members 14 and 15 can be adjusted right and left by way of the long holes 14A and 15A at the base portions thereof through which set screws are inserted, whereby the positions thereof relative to the hook portion 11A of the needle thread catching puller 11 and the pressure applied to the hook portion 11A by the clamping portions 14B and 15B which contact the hook portion 11A all over the both surfaces thereof can be properly set according to the thickness, kind, etc. of the needle thread NT.

Since the longitudinal direction of the gap M is conformed to the swinging direction of the hook portion 11A as set forth above and the tip end portion of each of the clamping portions 14B and 15B is curved so that the gap M may be gradually enlarged downward to form a wide gap MW at the lower end thereof, the hook portion 11A of the needle thread catching puller 11 can be easily introduced into the gap M. It is also possible to symmetrically arrange the first and second holding members 14 and 15 having the same shape on the lower surface of the horizontal portion of the bracket portion 2B.

The operation of the embodiment set forth above will be described hereinafter.

The thread end holding device for a sewing machine is in the state illustrated in FIG. 1 just before the operation. That is, a series of processes for sewing a cloth 13 are completed and a needle thread NT and a bobbin thread have been cut under the cloth 13 after an operator steps on a pedal, not shown, to operate a thread trimming device under the sewing machine bed 16. At this state, the needle 12 is adjacent to the upper dead point thereof, and the needle thread NT substantially vertically extends from the needle 12 into the cloth 13 along the path of the vertically reciprocal motion of the needle 12.

Successively, the control device supplies an electrical signal to the electromagnetic solenoid 3 so as to contract the plunger 3A thereinto against the resilience of the coiled spring 7, whereby the swinging link 6 is turned about the supporting shaft 4 by way of the connecting link 5 as illustrated in FIG. 2 to push the driving link 8 downward in the figure and turn the driving crank 10 in the direction of the arrow a together with the needle thread catching puller supporting shaft 9, so that the needle thread catching puller 11 fixed thereto is turned in the direction of the arrow b. When the needle thread catching puller 11 is turned, it is disengaged from the clamping portions 14B and 15B and the hook portion 11A thereof passes under the needle 12 which is positioned adjacent to the upper dead point thereof to reach its thread catching position at the extremity of swinging after pushing of the needle thread NT which extends substantially vertically along the path of the vertically reciprocal motion of the needle 12 at the chamfering portion 11C thereof.

Thereafter the supply of the electrical current to the electromagnetic solenoid 3 is stopped, when the plunger 3A rapidly projects again so that the needle thread catching puller 11 turns backward by way of the connecting link 5, the swinging link 6, the driving link 8, the driving crank 10 and the needle thread catching puller supporting shaft 9.

When the needle thread catching puller 11 turns backward, the hook portion 11A thereof catches the thread end NTE of the needle thread NT which extends downward from the needle 12 and returns to its home position by entering the gap M between the first and second holding members 14 and 15 which are located on the horizontal line which passes the center of the needle thread catching puller supporting shaft 9 as illustrated in detail in FIG. 3.

When the needle thread catching puller 11 returns to its home position in this way, the clamping portions 14B and 15B are elastically brought into contact with the front and rear surfaces of the hook portion 11A respectively, so that the needle thread NT which is retained and caught by the hook portion 11A in a bent state, is clamped to be held by the clamping portions 14B and 15B at both sides of the thread end NTE thereof. Since the bent portion of the needle thread end NTE cuts into the bottom portion 11D of the V-shaped hook portion 11A as illustrated in FIG. 3, it receives a large friction at the bottom portion 11D of the hook portion 11A adding to that applied thereto by the clamping portions 14B and 15B, so that it is held firmly.

Whereupon, the first and second holding members 14 and 15 may be substituted by one of integrally formed holding members having shapes of a letter W, an inversed U, etc.

As understood from the description set forth above, the present invention has the following effects.

(1) Since the thread end of the needle thread is clamped by the first and second holding members against the both surfaces of the hook portion of the needle thread catching puller and moreover it cuts into the hook portion, it is held firmly.

(2) Since the needle thread catching puller is linear substantially having no bent portion therein in a front view, it can be accommodated in the side of the sewing machine arm so that the sewing machine may be compact in size. Moreover, it is possible to keep the hook portion away from the upper surface of the needle throat when the needle thread catching puller is at its home position. As a result, it does not obstruct handling the cloth etc. on the needle throat so that it is possible to improve the efficiency of sewing operation.

(3) Since the needle thread catching puller can have a simple shape like a lever substantially having no bent portion in a front view, it is possible to further increase the rigidity thereof for improving durability. Since the needle thread catching puller engages the clamping portions of the first and second holding members only when it is located at its home position and consequently it can have a simple shape, it is able to be manufactured with ease.

Moreover, since the first and second holding members need not have complicated shapes in order that they may not prevent the operation of the needle thread catching puller, the shapes thereof between the base portions and the clamping portions for clamping the hook portion of the needle thread catching puller therebetween can be simple for stably securing the elastic clamping force so as to be easily manufactured for enhancing the economical effect and to be improved in the durability and in the reliability of operation. Furthermore, it is also possible to further enhance the economical effect by giving a same shape to the first and second holding members.

(4) Since the hook portion of the needle thread catching puller can catch the thread end of the needle thread effectively without forming a sharp projection at the lower end thereof, the problem that the cloth and the thread are caught by the sharp projection to prevent sewing operation is eliminated without lowing the catching ability, so that it is possible to improve the efficiency and safety of sewing operation.

What is claimed is:

1. In combination with a sewing machine having a sewing machine arm having two opposite sides, a thread end holding device comprising:

a needle thread catching puller which is swingably supported on one side of said arm by way of a supporting shaft and is driven to swing between a thread catch position and a return position by a driving devices said puller having a tip end with a hook portion therein for catching a needle thread extending from a needle when the puller is in the catch position and for holding said thread when the puller is in the return position; and first and second elastic spring members mounted on said one side of said arm, each member having an L shape with a fiat horizontal leg and a flat vertical leg, the members being disposed adjacent each other, with the two horizontal legs lying in a common horizontal plane and extending away from each other and with the two vertical legs being downwardly extending, parallel and closely spaced from each other to define a vertical gap therebetween, the two legs clamping an end of the thread in said gap therebetween when the puller is in the return position with the tip end disposed in said gap and the thread has been caught by the hook portion with the hook portion extending upward, the puller being disengaged from the gap and said vertical legs when in the catch position.

2. The combination as set forth in claim 3 wherein each vertical leg has a lower end with a curved tip, the curved tips in the vertical legs extending away from each other.

* * * * *